US007887080B2

(12) United States Patent
Hauglin

(10) Patent No.: US 7,887,080 B2
(45) Date of Patent: Feb. 15, 2011

(54) CROSS-COUNTRY OR TELEMARK BINDING

(75) Inventor: Bernt-Otto Hauglin, Røyken (NO)

(73) Assignee: Rottefella AS, Klokkarstua (NO)

( * ) Notice: Subject to any disclaimer, the term of this patent is extended or adjusted under 35 U.S.C. 154(b) by 211 days.

(21) Appl. No.: 11/579,249

(22) PCT Filed: Jan. 13, 2005

(86) PCT No.: PCT/IB2005/000116

§ 371 (c)(1),
(2), (4) Date: Oct. 18, 2007

(87) PCT Pub. No.: WO2005/113081

PCT Pub. Date: Dec. 1, 2005

(65) Prior Publication Data

US 2008/0129015 A1 Jun. 5, 2008

(30) Foreign Application Priority Data

May 19, 2004 (DE) ..... 10 2004 024 881

(51) Int. Cl.
*A63C 9/22* (2006.01)

(52) U.S. Cl. ..... 280/615; 280/634; 280/11.16

(58) Field of Classification Search ..... 280/615, 280/633, 634, 11.26, 11.16
See application file for complete search history.

(56) References Cited

U.S. PATENT DOCUMENTS 1,964,103 A 6/1934 Attenhoffer
2,094,667 A 10/1937 Parish
3,137,014 A * 6/1964 Meucci ..... 441/70
3,950,001 A * 4/1976 Weigl ..... 280/618
3,966,218 A * 6/1976 Beyl ..... 280/618
4,186,500 A 2/1980 Salzman
4,266,806 A * 5/1981 Weigl et al. ..... 280/618
4,273,355 A 6/1981 Storandt
4,310,170 A * 1/1982 Linecker ..... 280/636

(Continued)

FOREIGN PATENT DOCUMENTS

AT 354306 B 1/1980

(Continued)

OTHER PUBLICATIONS

PCT/IB2005/000116 ISR dated Apr. 21, 2005, published Jan. 13, 2005, Rottefella AS.

*Primary Examiner*—Jeffrey J Restifo
(74) *Attorney, Agent, or Firm*—Knobbe Martens Olson & Bear LLP

(57) ABSTRACT

Cross-country or telemark binding (10) which is mounted on the top face of a ski, especially on a mounting plate (12) mounted thereon, so as to be longitudinally displaceable (arrow 13) and which is lockable in a plurality of sliding positions by means of a locking device (14). The locking device is subdivided into a first locking unit (23), which is active only in the forward direction, and a second locking unit (24), which is active only in the rearward direction, so that on unlocking of that locking unit (23) which is active only in the forward direction the binding is displaceable only in the forward direction (arrow 25) and on unlocking of that locking unit (24) which is active only in the rearward direction the binding is displaceable only in the rearward direction (arrow 26).

8 Claims, 5 Drawing Sheets

U.S. PATENT DOCUMENTS

| | | | | |
|---|---|---|---|---|
| 4,322,090 | A | 3/1982 | Loughney | |
| 4,522,424 | A | 6/1985 | Luitz et al. | |
| 4,524,990 | A | 6/1985 | Svoboda et al. | |
| 4,571,858 | A | 2/1986 | Faulin | |
| 4,722,613 | A | 2/1988 | Jungkind | |
| 4,772,041 | A | 9/1988 | Klosterman et al. | |
| 4,887,833 | A | 12/1989 | Bailey | |
| 4,955,633 | A * | 9/1990 | Stritzl et al. | 280/633 |
| 5,088,756 | A | 2/1992 | Hue et al. | |
| 5,116,073 | A | 5/1992 | Goud et al. | |
| 5,125,680 | A | 6/1992 | Bejean et al. | |
| 5,143,395 | A | 9/1992 | Mayr et al. | |
| 5,190,309 | A | 3/1993 | Spitaler et al. | |
| 5,211,418 | A | 5/1993 | Scherubl | |
| D345,454 | S | 3/1994 | Hauglin | |
| 5,344,178 | A * | 9/1994 | Rohrmoser | 280/617 |
| 5,344,179 | A * | 9/1994 | Fritschi et al. | 280/618 |
| 5,356,169 | A | 10/1994 | Hue et al. | |
| 5,480,175 | A | 1/1996 | Astier et al. | |
| 5,484,149 | A * | 1/1996 | Lee | 280/11.26 |
| 5,498,017 | A * | 3/1996 | Rohrmoser | 280/633 |
| 5,671,941 | A | 9/1997 | Girad | |
| 5,732,968 | A | 3/1998 | Wladar et al. | |
| 5,765,854 | A * | 6/1998 | Moore et al. | 280/618 |
| 5,897,127 | A | 4/1999 | Hauglin | |
| 5,899,006 | A | 5/1999 | Donnadieu | |
| 5,924,719 | A | 7/1999 | Girard | |
| 5,944,336 | A | 8/1999 | Fagot | |
| 5,944,337 | A | 8/1999 | Girard et al. | |
| 6,017,050 | A | 1/2000 | Girard | |
| 6,065,895 | A * | 5/2000 | Lehner et al. | 403/105 |
| 6,092,829 | A * | 7/2000 | Mercier | 280/617 |
| 6,209,903 | B1 | 4/2001 | Girard | |
| 6,216,366 | B1 | 4/2001 | Donnadieu | |
| 6,289,610 | B1 | 9/2001 | Girard et al. | |
| 6,315,318 | B1 | 11/2001 | Caron et al. | |
| 6,374,517 | B2 | 4/2002 | Girard et al. | |
| 6,390,493 | B1 | 5/2002 | Hauglin | |
| 6,402,184 | B1 | 6/2002 | Hauglin | |
| 6,450,510 | B1 * | 9/2002 | Liu | 280/11.26 |
| 6,471,235 | B1 * | 10/2002 | Luitz et al. | 280/618 |
| 6,499,761 | B1 | 12/2002 | Quellais | |
| 6,547,261 | B2 * | 4/2003 | Gorza et al. | 280/11.223 |
| 6,588,791 | B1 | 7/2003 | Horn | |
| 6,612,592 | B1 * | 9/2003 | Soo | 280/11.16 |
| D488,294 | S | 4/2004 | Lancon | |
| 6,814,367 | B2 | 11/2004 | Mercier et al. | |
| 6,824,158 | B1 * | 11/2004 | Keller et al. | 280/618 |
| 7,036,842 | B2 * | 5/2006 | Krumbeck et al. | 280/618 |
| 7,207,591 | B2 | 4/2007 | Riedel et al. | |
| 7,264,263 | B2 | 9/2007 | Riedel et al. | |
| 2003/0155742 | A1 | 8/2003 | Riedel et al. | |
| 2004/0164519 | A1 | 8/2004 | Quellais et al. | |
| 2004/0207177 | A1 | 10/2004 | Riedel et al. | |
| 2004/0262886 | A1 | 12/2004 | Girard | |
| 2006/0145452 | A1 | 7/2006 | Bjertnaes | |
| 2008/0203703 | A1 | 8/2008 | Hauglin et al. | |

FOREIGN PATENT DOCUMENTS

| | | | |
|---|---|---|---|
| CH | 557154 | | 12/1974 |
| DE | 1 929 885 | | 12/1965 |
| DE | 24 18 577 | A | 10/1975 |
| DE | 327 066 | | 1/1976 |
| DE | 26 45 007 | | 10/1976 |
| DE | 27 14 853 | A | 10/1978 |
| DE | 27 28 747 | A | 1/1979 |
| DE | 3113942 | A1 | 10/1982 |
| DE | 32 22 132 | A1 | 12/1983 |
| DE | 37 85 420 | T2 | 6/1987 |
| DE | 3838569 | | 6/1989 |
| DE | 39 24 939 | A1 | 5/1990 |
| DE | 4229039 | | 4/1993 |
| DE | 93 20 530 | | 10/1994 |
| DE | 195 17 791 | A1 | 5/1995 |
| DE | 200 07 032 | U1 | 9/2000 |
| DE | 102004023832 | | 11/2002 |
| DE | 10124893 | | 11/2003 |
| DE | 10 2004 018 296 | A1 | 2/2005 |
| DE | 10 2004 024 881.8 | | 4/2005 |
| DE | 10319675 | | 6/2005 |
| EP | 0029206 | A | 5/1981 |
| EP | 0787440 | | 8/1997 |
| EP | 0 820 790 | A | 1/1998 |
| EP | 0878218 | | 11/1998 |
| EP | 0 908 204 | A2 | 4/1999 |
| EP | 0 951 926 | A | 10/1999 |
| EP | 1240925 | | 9/2002 |
| FR | 2569119 | | 2/1986 |
| FR | 2 556 188 | A1 | 12/1993 |
| FR | 2 741 543 | | 5/1997 |
| FR | 2 742 060 | | 6/1997 |
| FR | 2 803 178 | A1 | 12/1999 |
| NO | 319592 | | 7/2003 |
| WO | WO 88/04563 | | 6/1988 |
| WO | WO 96/23558 | | 8/1996 |
| WO | WO 01 66204 | A | 9/2001 |
| WO | WO0249728 | | 6/2002 |
| WO | WO03/101555 | | 12/2003 |
| WO | WO2004/045728 | | 6/2004 |
| WO | WO 2006/072812 | A1 | 7/2006 |

* cited by examiner

CROSS-COUNTRY OR TELEMARK BINDING

CROSS REFERENCE TO RELATED APPLICATIONS

This application claims the benefit and priority to and is a U.S. National Phase of PCT International Application Number PCT/IB2005/000116, filed on Jan. 13, 2005 designating the United States of America and published in the English language, which claims priority under 35 U.S.C. §119 to German Application Number DE 10 2004 024 881.8 on May 19, 2004. The disclosures of the above-referenced applications are hereby expressly incorporated by reference in their entireties.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION (1) Field of the Invention

The present invention relates to a cross-country or telemark binding which is mounted on the top face of a ski, especially on a mounting plate mounted thereon, so as to be longitudinally displaceable and which is lockable in a plurality of sliding positions by means of a locking device.

(2) Description of Related Art

Especially in the area of alpine skiing there is a very great variety of arrangements for adjusting front and/or rear jaws in the longitudinal direction of the ski in order to match the overall unit consisting of front and rear jaws to a ski boot and to adjust the intensity of the force with which the sole of the boot is clamped between the two jaws. In that respect, reference is made, by way of example, to DE 39 24 939 A1.

BRIEF SUMMARY OF THE INVENTION

Starting from that prior art, the present invention is based on the problem of providing an appropriate adjusting device for a cross-country or telemark binding, which device is simple to produce and also, above all, simple to use, without losing the functional reliability of the binding.

In accordance with the invention, the problem is solved by an arrangement according to the characterising part of claim 1, with preferred arrangement details being described in the subordinate claims.

DETAILED DESCRIPTION OF THE INVENTION

Figure 1:
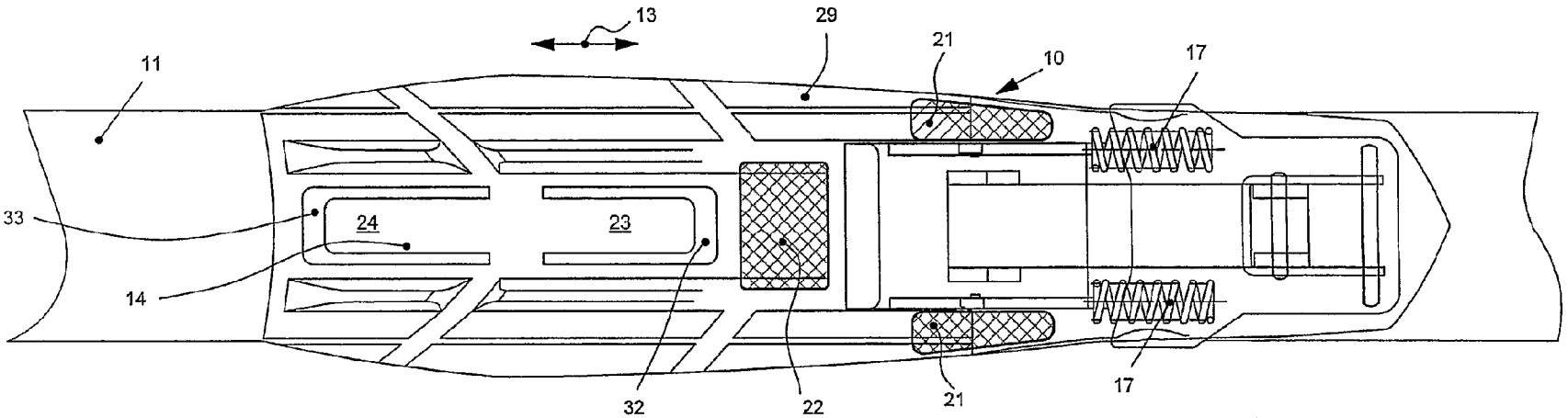
FIG. 1 is a top view, in diagrammatic form, of a binding according to the invention.

The binding according to the invention accordingly comprises a locking device which is subdivided into a first locking unit, which is active only in the forward direction, and a second locking unit, which is active only in the rearward direction, so that on unlocking of that locking unit which is active only in the forward direction the binding is displaceable only in the forward direction and on unlocking of that locking unit which is active only in the rearward direction the binding is displaceable only in the rearward direction. By that means, the user is provided with the assurance that, on unlocking of one of the two locking units, he can only ever displace the binding in the corresponding direction, that is to say either only in the forward direction or only in the rearward direction. The locking unit active in the opposite direction does not impede displacement in the direction that has been released. In order to push the binding back into the original position or into an intermediate position it is necessary to unlock that locking unit which is active in the respectively opposite direction.

Because the locking unit preferably comprises, on the one hand, locking teeth and, on the other hand, complementary locking notches, step-wise adjustment of the binding either in the forward direction or in the rearward direction is possible in accordance with the invention, the length of the individual steps being dependent on the afore-mentioned tooth arrangement.

An especially simple embodiment of the binding according to the invention is characterised in that the locking elements associated with the binding are integral components of the binding, especially of the binding housing or of an associated binding plate. Advantageously, the locking elements are in the form of tongues that are integrally formed or connected in articulated manner so as to be flexurally resilient. In order to put that arrangement into practical form, the locking elements are punched out from a binding plate as an integral part thereof. That locking tongue which is active in the forward direction is delimited by a punched-out line in a U-shape open in the rearward direction and that locking tongue which is active in the rearward direction is delimited by a punched-out line in a U-shape open in the forward direction. For the purpose of unlocking it is necessary merely to engage either underneath the front locking tongue or underneath the rear locking tongue with a screwdriver or the like in order to lift up the locking tongue. As a result, the locking between, on the one hand, the locking teeth arranged on the underside of the locking tongues and, on the other hand, the notches associated with the ski or the mounting plate is released.

In order to achieve the aim, in accordance with the invention, of action of the locking units only in the forward direction or only in the rearward direction in a manner that is simple in terms of construction, there are formed on the undersides of each of the previously mentioned locking tongues at least one slanting tooth, especially a slanting tooth profile, the front flank(s) of the tooth or teeth of that locking element which is active only in the forward direction extending substantially vertically, whereas the situation in the case of the tooth or teeth of that locking element which is active only in the rearward direction is just the opposite. The respective other flank extends preferably at a flat slant towards the rear or towards the front depending on whether the teeth are teeth of that locking element which is active only in the forward direction or of that locking element which is active only in the rearward direction.

Also advantageous in conjunction with the above-mentioned technical arrangement is a mounting plate which is of very thin or almost foil-like construction. Preferably, the mounting plate is produced by injection moulding. It is, however, also feasible in principle for the mounting plate to be produced by stamping a flat foil into shape, in which case the mounting plate is made primarily from plastics material, for example acrylonitrile-butadiene-styrene copolymer (ABS). That plastics material can be reinforced with carbon fibres if required.

It is furthermore advantageous if the mounting plate is adhesion-bonded or fusion-bonded, substantially over its entire area, to the top face of the ski. As a result, the mounting plate behaves like an integral component of the top face of the ski or of the top laminate defining the top face of the ski. The mounting plate does not therefore constitute an external body that is foreign to the ski. In addition, that kind of connection does not give rise to local, especially punctiform, stress locations such as those formed by, for example, screw connections. Accordingly it is also ensured that high tensile forces can be applied to the mounting plate without a destructive effect. The adhesion-bonded or fusion-bonded connection returns to its original state after the loading has ceased (hysteresis). The design is positively "forgiving" of excessive loads. The situation is different in the case of punctiform screw connections. In the case of excessive tension on a screw connection, it becomes loose. Return to the original fixing state is not ensured. Further to the above explanations, reference is made to WO 2004/045728 A2 in respect of the mounting plate.

Figure 2:
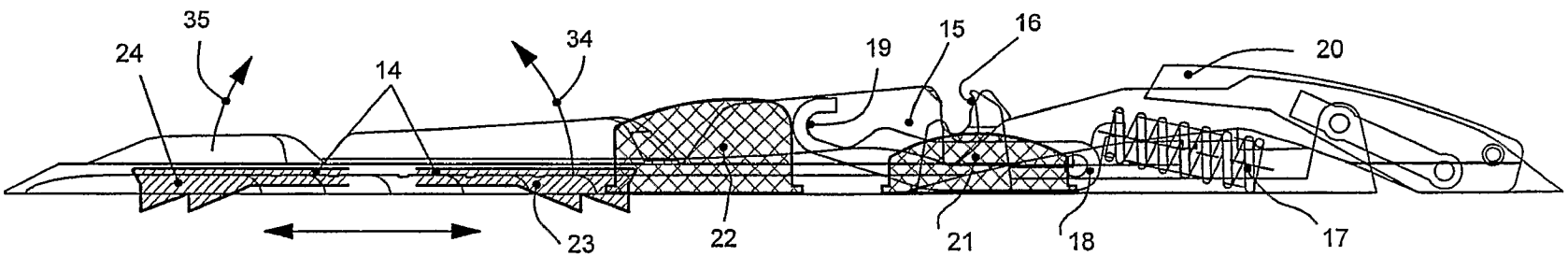
FIG. 2 is a side view, in partially cut-away diagrammatic form, of the binding according to claim 1.
Figure 3:
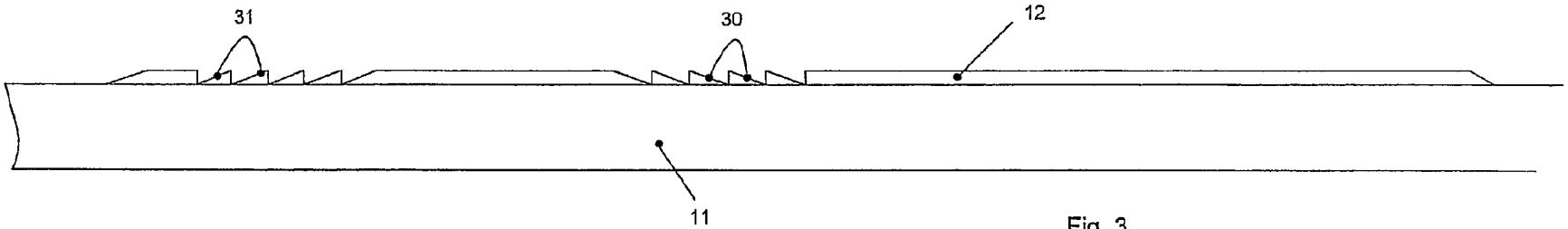
FIG. 3 is a side view of part of a ski having a mounting plate mounted on the top face of the ski.
Figure 4:
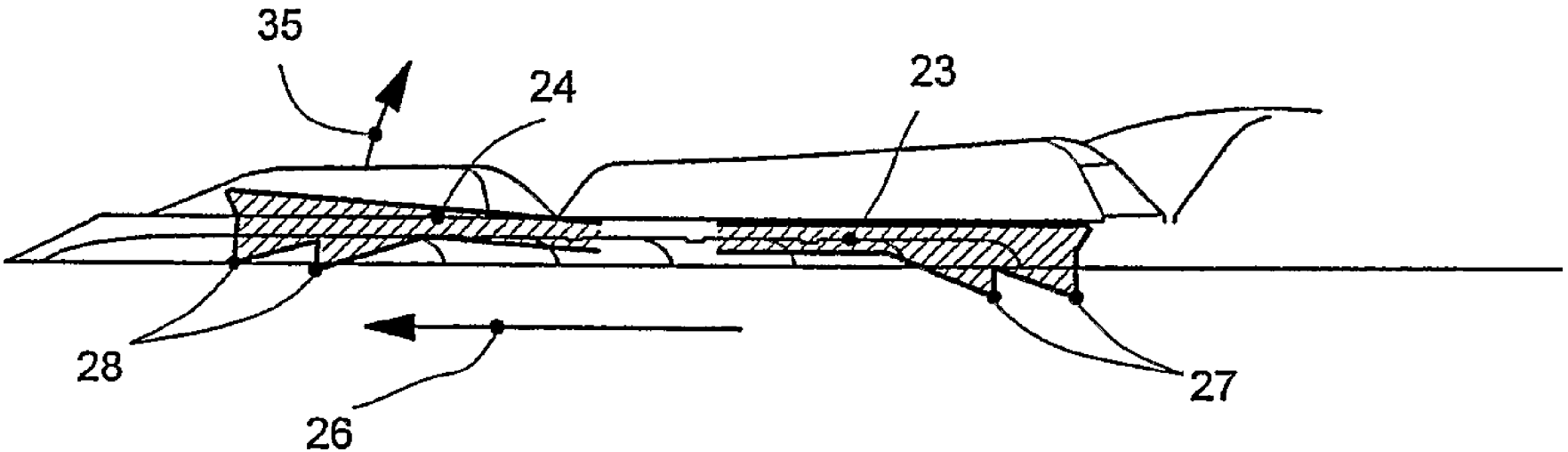
FIG. 4 is a side view, in partial longitudinal section, of part of the binding, showing unlocking of a rear locking unit.
Figure 5:
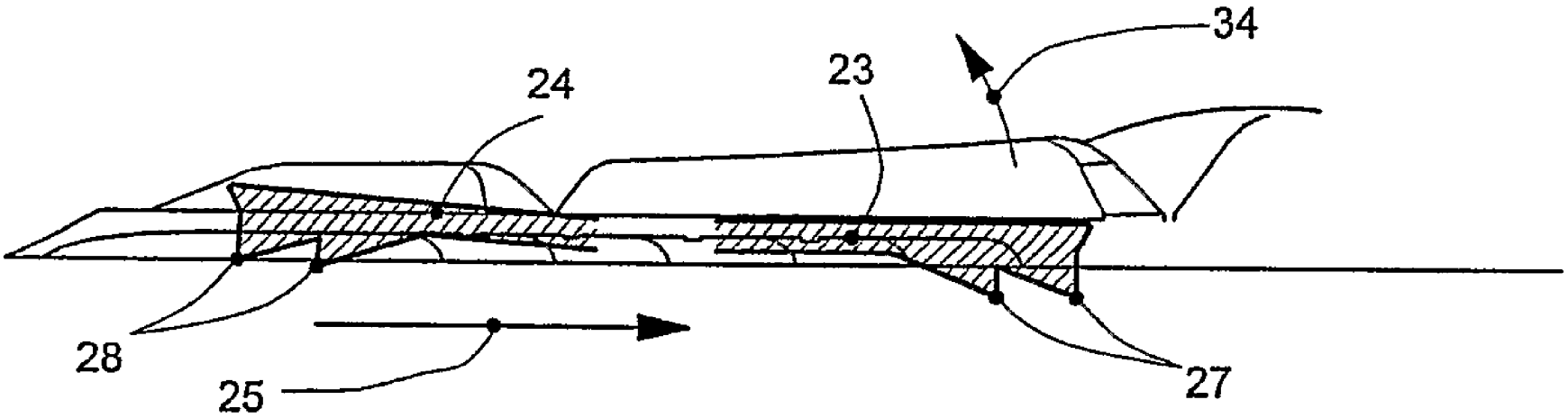
FIG. 5 is a side view, in partial longitudinal section, of part of the binding, showing unlocking of a front locking unit.

A preferred embodiment of a cross-country or telemark binding in accordance with the invention will be explained hereinbelow in greater detail with reference to the accompanying drawings, in which:

FIG. 1 is a top view, in diagrammatic form, of a binding according to the invention;

FIG. 2 is a side view, in partially cut-away diagrammatic form, of the binding according to claim 1;

FIG. 3 is a side view of part of a ski having a mounting plate mounted on the top face of the ski;

FIG. 4 is a side view, in partial longitudinal section, of part of the binding, showing unlocking of a rear locking unit; and FIG. 5 is a side view, in partial longitudinal section, of part of the binding, showing unlocking of a front locking unit.

FIG. 1 shows a cross-country or telemark binding 10 which is mounted on the top face of a ski 11, especially on a mounting plate 12 mounted thereon (see FIG. 3), so as to be longitudinally displaceable (see double arrow 13 in FIG. 1) and which is lockable in a plurality of sliding positions by means of a locking device 14. The binding shown is of a kind such as is described in German Patent Application 10 2004 018 296.5 belonging to the Applicant (not yet published). This binding is designed for boots the soles of which each have, at a spacing from the front end of the sole, a sole-associated engagement element which so co-operates with a complementary binding-associated engagement element 15 (see FIG. 2) that the heel 3 of the boot can be lifted up. Between the sole-associated engagement element and the front end of the sole of the associated boot there is formed, in the sole, a projecting part which can be so brought into contact with a binding-associated catch 16 that the boot is held in engagement by means of the binding-associated engagement element 15 and, at the same time, can carry out an a movement upwards and downwards about a notional transverse axis behind the catch 16. The binding-associated engagement element 15, and consequently a boot connected thereto, is capable of pivoting upwards about a horizontal axis 18 extending across the longitudinal direction of the boot and the binding, against the action of a resilient element, especially a helical compression spring 17 (see FIG. 2). The sole-associated engagement element is a transverse axis arranged inside a sole recess, as is already known for cross-country or telemark ski boots. The binding-associated engagement element 15 comprises in the present case an engagement hook 19. The binding-associated engagement element 15 is mounted so as to be longitudinally displaceable and, by means of an actuation device (actuation lever 20), is movable from a boot release and insertion position into a closed position and vice-versa. The boot is held in balanced contact with the binding and ski by means of, on the one hand, a front flexor 21 associated with the front end of the sole and, on the other hand, a rear flexor arranged in the region of the metatarsophalangeal zone, especially in front thereof, lifting the heel of the boot being additionally accomplished, in the end phase of the lifting thereof, against the action of the front flexor 21, whereas in the initial phase of lifting the heel of the boot first only the rear flexor 22 and then both flexors 21, 22 are active, especially before the return spring 17 becomes active.

The locking device 14 is subdivided into a first locking unit 23, which is active only in the forward direction, and a second locking unit 24, which is active only in the rearward direction, so that on unlocking of that locking unit 23 which is active only in the forward direction the binding can be displaced only in the forward direction (arrow 25 in FIG. 5) and on unlocking of that locking unit 24 which is active only in the rearward direction the binding can be displaced only in the rearward direction (arrow 26 in FIG. 4). The locking units 23, 24 each consist of a resiliently biased locking element associated with the binding and comprising tongues punched out of a binding plate, on the underside of which there are formed locking teeth 27, 28, and of a locking element formed in the ski or mounting plate and having notches 30, 31, which accommodate the locking teeth 27, 28, and which especially are complementary thereto (see FIG. 3). The locking elements associated with the binding are—as already mentioned—integral components of the binding, in this case of the binding plate 29 associated with the binding. They are tongues punched out of the binding plate and accordingly are formed on the binding plate so as to be flexurally resilient. The tongue of the front locking unit 23 is delimited by a punched-out region 32 in a U-shape (in top view) open towards the rear, and the tongue associated with the rear locking unit 24 is delimited by a punched-out region 33 in a U-shape open towards the front. As can be seen very well from FIGS. 2, 4 and 5, slanting tooth profiles are formed on the underside of the locking tongues, the front flank of the teeth 27 of that locking element which is active only in the forward direction extending substantially vertically, whereas in the case of the teeth 28 associated with that locking element which is active only in the rearward direction the rear flank extends approximately vertically. The complementary notches 30, 31 on the upper side of the mounting plate 12 are correspondingly formed. The respective opposite flanks are in each case at a flat angle so that on lifting of, for example, the front locking tongue in accordance with arrow 34 in FIG. 5 the corresponding lock is removed so that the binding 10 can be displaced in the forward direction. On lifting the rear locking tongue in the direction of arrow 35 in FIG. 4 the rearward lock is released and the binding 10 can be displaced in the rearward direction. This displacement in the direction of arrows 25 and 26 is not hindered by the flatly angled flanks of the rear locking teeth 28 and front locking teeth 27, respectively.

The mounting plate 12 can be made of plastics material or light metal, especially aluminium. Preferably, however, it is made of plastics material and is adhesion-bonded in lasting manner to the top face of the ski, by means of which the body of the ski is impaired the least. The mounting plate 12 preferably has a flexural behaviour like the upper surface of the body of the ski 11.

It should also be mentioned that it is also feasible in principle for just one single integral locking tongue to be formed in the binding plate 29, which is then active both in the forward direction and also in the rearward direction. Instead of the locking teeth described and shown, there are then used, for example, locking pins with associated locking holes. What is important is that, in this embodiment too, the binding-associated locking elements are in the form of integral locking tongues so that separate components, especially springs or the like, are not necessary.

All features disclosed in the application documents are claimed as being important to the invention insofar as they are novel on their own or in combination compared with the prior art.

REFERENCE NUMERALS

10 binding
11 ski
12 mounting plate
13 double arrow
14 locking device
15 engagement element
16 binding-associated catch
17 helical compression spring(s)
18 pivot axis
19 engagement hook
20 actuation lever
21 front flexor
22 rear flexor
23 first locking unit
24 second locking unit
25 arrow
26 arrow
27 locking teeth
28 locking teeth
29 binding plate
30 notches
31 notches
32 U-shaped punched-out region
33 U-shaped punched-out region
34 arrow
35 arrow

The invention claimed is:

1. A cross-country or telemark ski binding adapted for mounting on the top face of a ski or on a mounting plate mounted thereon, and adapted to be longitudinally displaceable, said binding including a locking device operative to lock said binding in a plurality of sliding positions, wherein said locking device is subdivided into a first locking unit, which is active only in the forward direction, and a second locking unit, which is active only in the rearward direction, the arrangement being such that on unlocking of that locking unit which is active only in the forward direction said binding is displaceable only in the forward direction and on unlocking of that locking unit which is active only in the rearward direction said binding is displaceable only in the rearward direction, wherein said locking units each comprise, associated with the binding, a resiliently biased locking element having locking teeth and, associated with the ski or mounting plate, a counterpart locking element having notches accommodating the locking teeth;

wherein locking elements associated with the binding are in each case tongues that are integrally formed or connected in articulated manner so as to be flexurally resilient on the undersides of which tongues there are formed in each case at least one slanting tooth, a slanting tooth profile, the front flank of the tooth or teeth of the locking element which is active only in the forward direction extending substantially vertically, whereas the situation in the case of the tooth or teeth of that locking element which is active only in the rearward direction is just the opposite.

2. A binding according to claim 1, wherein the locking elements associated with the binding are integral components of the binding.

3. A binding according to claim 2, wherein the locking elements associated with the binding are integral components of an associated binding plate of said binding.

4. A binding according to claim 3, wherein the locking elements associated with the binding are punched out from an associated binding plate of said binding so as to be integral components of the binding plate.

5. A binding according to claim 1, wherein the locking device has at least one locking element selected from the group consisting of an integral part of the locking device, an integral part of the binding, and an integral part of a binding plate associated with the said binding.

6. A binding according to claim 5, wherein said at least one locking element is in the form of a tongue integrally connected to an element selected from the group consisting of said binding, a binding plate associated with said binding, and a heel plate associated with said binding, said tongue, having a locking projecting part or a locking recess for complementary locking elements on the mounting plate.

7. A binding according to claim 1, wherein the locking unit active in the rearward direction does not impede displacement of the binding in the forward direction that has been released, whereas the locking unit active in the forward direction does not impede displacement of the binding in the rearward direction when the locking unit active in the rearward direction has been released.

8. A binding according to claim 1, wherein, on unlocking, said flexurally resilient tongue is lifted up so that locking between the locking tooth or teeth arranged on the underside of the tongue and the notches associated with the ski or the mounting plate is released.

* * * * *